US009105963B2

(12) United States Patent
Mertel

(10) Patent No.: US 9,105,963 B2
(45) Date of Patent: Aug. 11, 2015

(54) TUNABLE YAGI AND OTHER ANTENNAS

(71) Applicant: Fluidmotion, Inc., Bellevue, WA (US)

(72) Inventor: Michael E. Mertel, Bellevue, WA (US)

(73) Assignee: Fluidmotion, Inc., Bellevue, WA (US)

( * ) Notice: Subject to any disclaimer, the term of this patent is extended or adjusted under 35 U.S.C. 154(b) by 361 days.

(21) Appl. No.: 13/686,037

(22) Filed: Nov. 27, 2012

(65) Prior Publication Data

US 2014/0145888 A1 May 29, 2014

(51) Int. Cl.

| | |
|---|---|
| ***H01Q 11/12*** | (2006.01) |
| ***H01Q 1/12*** | (2006.01) |
| ***H01Q 3/01*** | (2006.01) |
| ***H01Q 19/30*** | (2006.01) |

(52) U.S. Cl.

CPC ..... *H01Q 1/1235* (2013.01); *H01Q 3/01* (2013.01); *H01Q 19/30* (2013.01)

(58) Field of Classification Search

USPC ..... 343/723, 896, 874, 886

See application file for complete search history.

(56) References Cited

U.S. PATENT DOCUMENTS

| | | | | |
|---|---|---|---|---|
| 2,476,469 | A | | 7/1949 | Walker |
| 2,632,107 | A | | 3/1953 | Hlivjak |
| 2,967,300 | A | | 1/1961 | Haughawout |
| 3,487,415 | A | | 12/1969 | Simons |
| 3,653,056 | A | | 3/1972 | Peterson |
| 3,683,391 | A | | 8/1972 | Callaghan |
| 3,931,626 | A | | 1/1976 | Simons |
| 3,971,031 | A | | 7/1976 | Burke |
| 4,028,709 | A | | 6/1977 | Berkowitz et al. |
| 4,145,694 | A | | 3/1979 | Sletten |
| 4,290,071 | A | | 9/1981 | Fenwick |
| 4,514,734 | A | | 4/1985 | Cermignani et al. |
| 4,604,628 | A | | 8/1986 | Cox |
| 4,667,204 | A | | 5/1987 | Hedrick |
| 4,785,308 | A | | 11/1988 | Newcomb |
| 5,028,932 | A | * | 7/1991 | Boor ..... 343/723 |
| 5,061,944 | A | | 10/1991 | Powers et al. |
| 5,189,435 | A | | 2/1993 | Yarsunas et al. |

(Continued)

FOREIGN PATENT DOCUMENTS

| | | | |
|---|---|---|---|
| JP | 2005260898 | A | 9/2005 |

OTHER PUBLICATIONS

Gibson, William, "A Teletuned 10 Meter Beam," QST, Cover page and p. 35, Aug. 1952.

(Continued)

*Primary Examiner* — Dieu H Duong

(74) *Attorney, Agent, or Firm* — Leech Tishman Fuscaldo & Lampl; Kenneth D'Alessandro, Esq.

(57) ABSTRACT

A tunable antenna is formed on a boom. First and a second opposed non-conductive support pole extend from a first end of the boom. Third and a fourth opposed non-conductive support pole extending from a second end of the boom. Each pole has a wire guide at its end. First and second spools are mounted near the first end of the boom. Third and fourth spools are mounted near the second end of the boom. First and second wires are spooled on the first and second spools. A third wire is spooled on the third spool and mechanically coupled to the first wire by a non-conductive cord, the first and third wires running through the first and third pole guides. A fourth wire is spooled on the fourth spool and mechanically coupled to the second wire by non-conductive cord, the second and fourth wires running through the second and fourth pole guides.

17 Claims, 9 Drawing Sheets

(56) References Cited

U.S. PATENT DOCUMENTS

| | | | |
|---|---|---|---|
| 5,293,172 | A | 3/1994 | Lamberty et al. |
| 5,841,406 | A | 11/1998 | Smith |
| 5,865,390 | A | 2/1999 | Iveges |
| 5,945,962 | A | 8/1999 | Harrington et al. |
| 5,995,061 | A | 11/1999 | Schiller |
| 6,154,180 | A | 11/2000 | Padrick |
| 6,300,912 | B1 | 10/2001 | Pla |
| 6,677,914 | B2 | 1/2004 | Mertel |
| 7,205,953 | B2 | 4/2007 | Knadle, Jr. et al. |
| 7,463,211 | B2 | 12/2008 | Mertel et al. |
| 2002/0171598 | A1 | 11/2002 | Mertel |
| 2005/0057425 | A1 | 3/2005 | Mendenhall et al. |
| 2005/0237256 | A1 | 10/2005 | Regala |
| 2010/0277388 | A1 | 11/2010 | Wright |
| 2013/0147671 | A1* | 6/2013 | Schweppe ..... 343/723 |

OTHER PUBLICATIONS

Advertisement for "Cliff-Dweller" by New-Tronics, Model CD 40-75, QST, p. 138, Dec. 1964.

Advertisement for New-tronics Cliff-Dweller, QST, p. 109, date unknown.

* cited by examiner

Driven = 18.67 Ft
Reflector = 19.20 Ft

Driven = 15.92 Ft
Reflector = 16.5 Ft

TUNABLE YAGI AND OTHER ANTENNAS

BACKGROUND

1. Field of the Invention

The present invention relates to resonant antennas. More particularly, the present invention relates to tunable antennas and to a portable tunable Yagi antenna.

2. The Prior Art

The initial assembly of current portable Yagi antennas, as well as most vertical and dipole antennas, takes a considerable amount of time. Worse yet, to change frequency and adjust the antenna for a good feedline match requires taking the antenna down and making mechanical and or electrical adjustments. Despite all of the effort required, currently-available portable Yagi antennas offer a very low level of performance.

Existing designs use one or more of the following techniques to change frequency: physically adding lengths of aluminum to the element(s), introducing inductance to change the electrical element length, either by swapping fixed inductors in and out to effect band changes or by providing a motor driven variable inductor. In the case of manually swapping the coils it is usually also necessary to also change the physical length of the antenna. These procedures are very time consuming and results in a very lossy antenna. The motor driven inductor types of antennas suffer additional losses because the maximum physical length is determined by the highest frequency at which the antenna operates, thus reducing efficiency greatly on all frequencies below the upper limit because the fixed radiator is much too short. Because of the large values of inductance required, current portable antennas have relatively modest power handling ability, typically about 100 w to 500 w. To solve these problems a new type of element is needed.

BRIEF DESCRIPTION

According to a first embodiment of the present invention, a tunable antenna is formed on a boom. First and a second opposed non-conductive support pole extend from a first end of the boom. Third and a fourth opposed non-conductive support pole extending from a second end of the boom. Each pole has a wire guide at its end. First and second spools are mounted near the first end of the boom. Third and fourth spools are mounted near the second end of the boom. First and second wires are spooled on the first and second spools. A third wire is spooled on the third spool and mechanically coupled to the first wire by a non-conductive cord, the first and third wires running through the first and third pole guides. A fourth wire is spooled on the fourth spool and mechanically coupled to the second wire by non-conductive cord, the second and fourth wires running through the second and fourth pole guides. The antenna may be horizontally or vertically polarized.

Variations of this embodiment of the invention employ different ways to adjust the lengths of the wires thereby adjusting the frequency of operation of the antenna of the present invention.

According to another embodiment of the present invention, a tunable vertical antenna is disclosed that can also serve as one side of a dipole antenna.

BRIEF DESCRIPTION OF THE DRAWING FIGURES

DETAILED DESCRIPTION

Persons of ordinary skill in the art will realize that the following description of the present invention is illustrative only and not in any way limiting. Other embodiments of the invention will readily suggest themselves to such skilled persons.

An illustrative embodiment will be disclosed for operation at frequencies between about 7 MHz and about 30 MHz. Persons of ordinary skill in the art will readily recognize that, from the disclosure of the illustrative embodiment, the antenna of the present invention may be easily scaled to operate over other frequency ranges.

Figure 1:
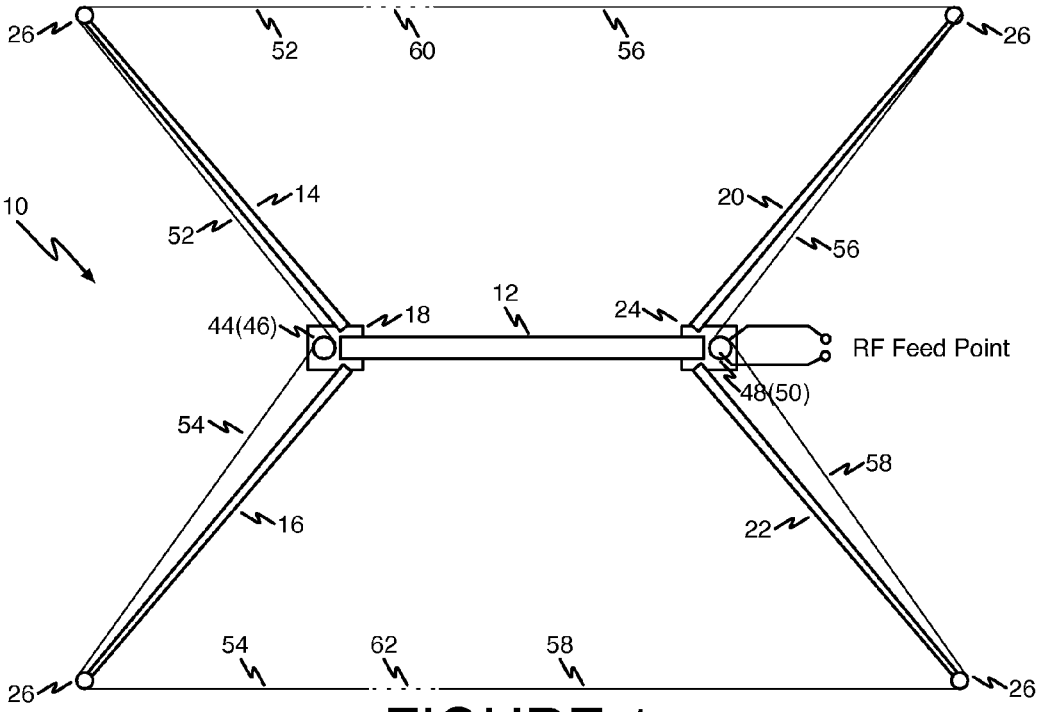
FIG. 1 is a top schematic view of an illustrative antenna according to one aspect of the present invention.
Figure 2:
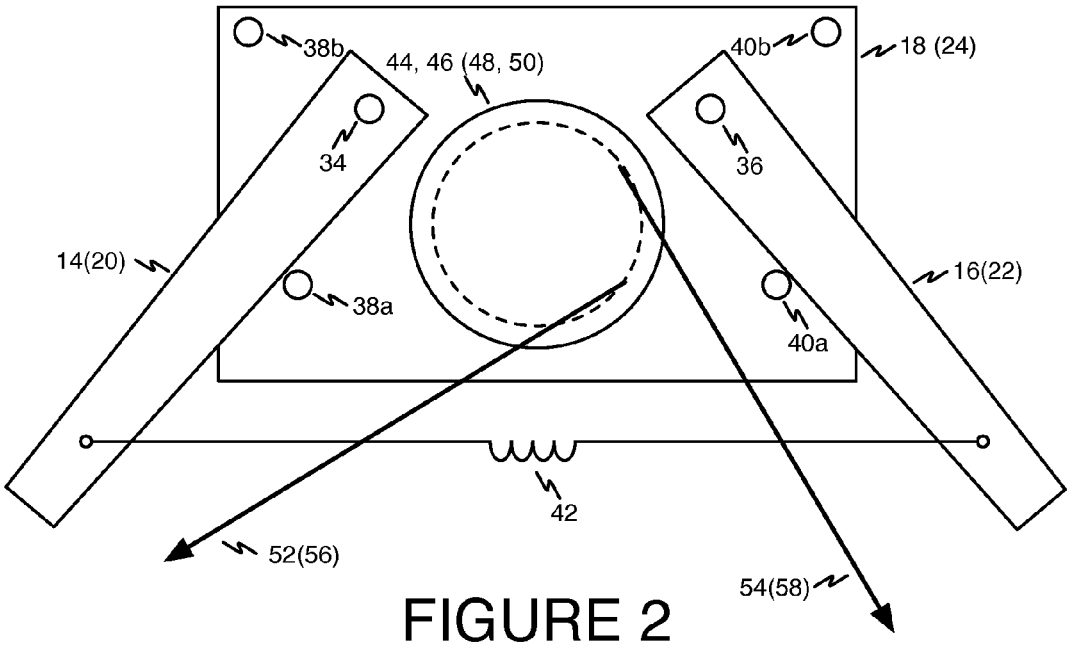
FIG. 2 is a diagram showing a closer view of one of the two mounting plates, including a pair of support poles, and wire reels of the antenna of FIG. 1.

Referring now to FIGS. 1 and 2, an illustrative antenna according to one aspect of the present invention is depicted. FIG. 1 is a top schematic view of an illustrative antenna 10 according to one aspect of the present invention. FIG. 2 is a diagram showing a closer view of one of the two mounting plates, including a pair of support poles, and wire reels of the antenna of FIG. 1.

In the non-limiting example shown in FIGS. 1 and 2, the antenna 10 according to the present invention may include hinged or multiple section boom 12, having a length of, for example, about 5 feet. At a first end of the boom 12, first and second non-conductive flexible poles 14 and 16, having a length of, for example, about 10 feet, are pivotally mounted opposite one another on mounting plate 18. Mounting plate 18 is attached to the first end of the boom. At a second end of the boom opposite the first end, third and fourth non-conductive flexible poles 20 and 22, having a length of, for example, about 10 feet, are pivotally mounted opposite one another on mounting plate 24. Mounting plate 24 is attached to the second end of the boom. A guide 26 is disposed at the distal end of each of the poles 14, 16, 20, and 22. Guide 26 may be in the form of an open loop or a pulley, etc. and allows the wire forming the antenna elements to easily slip through guide 26.

Pole 14 is pivotally mounted to mounting plate 18 by pivot 34 and pole 16 is pivotally mounted to mounting plate 18 by pivot 36 (FIG. 2). Stop pins 38*a* and 40*a* limit the rotation of poles 14 and 16 in a direction towards each other, and stop pins 38*b* and 40*b* limit the rotation of poles 14 and 16 in a direction away from each other. Similar features are provided for poles 20 and 22 on mounting plate 24. Poles 14 and 16 are biased in a direction towards each other by means of a spring or elastic member such as a bungee cord indicated at reference numeral 42.

First and second spools 44 and 46 are disposed on the mounting plate 18 at the first end of the boom, and third and fourth spools 48 and 50 are disposed on the mounting plate 24 at the second end of the boom. In one embodiment of the invention, the pairs of spools at both ends are mounted on a common shaft and are locked to that shaft. According to another embodiment of the invention, spools 44 and 46 may rotate independently or be locked together as may spools and 48 and 50.

A pair of wires 52 and 54 are unwound from the first and second spools 44 and 46. A pair of wires 56 and 58 are unwound from the third and fourth spools 48 and 50. Wire 52 passes through guide 26 at the end of pole 14, and wire 54 passes through a similar guide 26 at the end of pole 16. Wire 56 passes through guide 26 at the end of pole 20 and wire 58 passes through a similar guide 26 at the end of pole 22. Persons of ordinary skill in the art will readily understand that the words "wire" or "wires" as used herein also includes, without limitation, conductive tapes and other flexible conductors. Wire 52 is connected to wire 56 by a length of non-conductive cord 60. Wire 54 is connected to wire 58 by a length of non-conductive cord 62. The lengths of the non-conductive cords 60 and 62 are non-critical with lengths ranging from about 12 inches to about 48 inches being particularly suitable. In the illustrative embodiment discussed herein, 32 inches was chosen for the cord length to best accommodate the mechanical design.

Electrical contact is made to spools 48 and 50 to apply RF power to conductors 56 and 58 to form a driven element. Wires 52 and 54 are connected together to allow a passive element to be formed. Spools 44, 46, 48, and 50 may be formed from a conductive material and contact may be made by means of brushes, wipers, etc. Alternately, wires 56 and 58 may be passed through conductive sleeves to which contact can be made, or the wires can pass through a dielectric tube surrounded by a conductive tube to capacitively couple the RF power.

Winding or unwinding the wires from either pair of spools (e.g., wires 52 and 54 or wires 56 and 58) while simultaneously winding the wires from the other pair of spools (e.g., wires 56 and 58), and vice-versa allows setting the lengths of the wires from the pairs of spools in accordance with the present invention. By this action, the different antenna configurations of the antenna of the present invention are achieved as will now be shown with reference to FIGS. 3 through 9. For an ease of understanding the present invention, FIGS. 3 through 9 show the boom 12 and extended wires and omit the spools. The poles are shown in dashed lines. Persons of ordinary skill in the art will recognize that the illustrative diagrams of FIGS. 3 through 9 show an embodiment of the antenna of the present invention scaled in size for operation between about 7 MHz and about 28.5 MHz. Such skilled persons will readily recognize that by differently scaling the size of the antenna of the present invention, operation over frequency ranges different from those shown in FIGS. 3 through 9 is possible.

As noted, wires 56 and 58 form a driven element. Wires 52 and 54 form a passive director or reflector element for frequencies where Yagi antennas are possible (in this illustrative embodiment 14 MHz through 30 MHz) and are at lengths that are out of resonance at other frequencies and do not form a part of the antenna at such frequencies.

Figure 3:
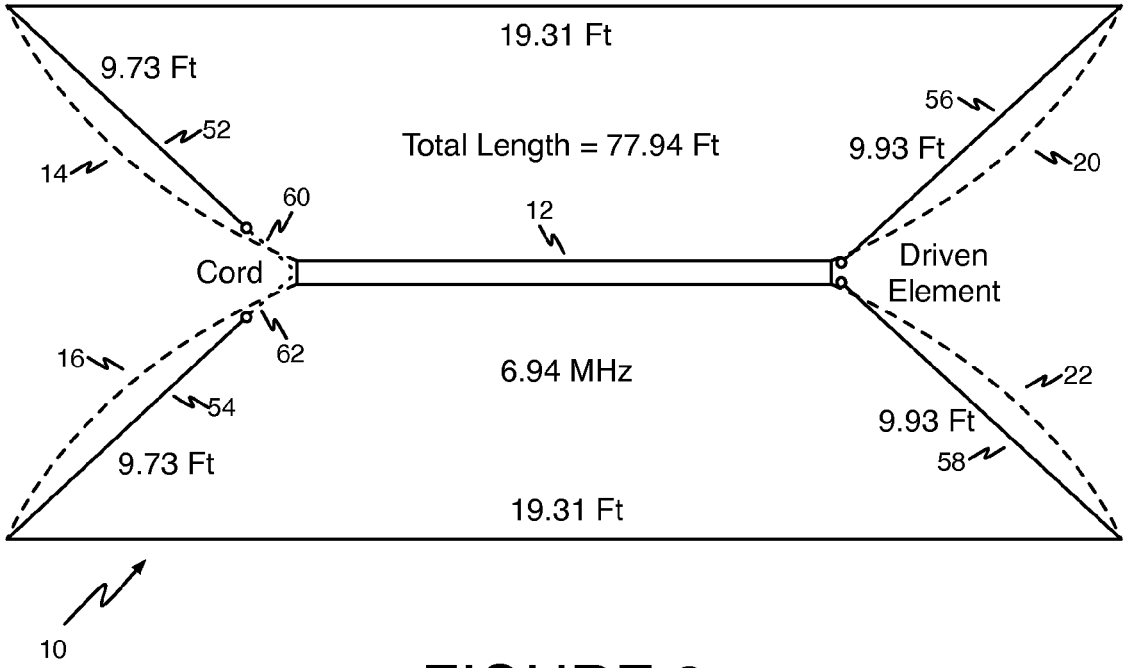
FIG. 3 is a diagram showing a top view of the illustrative embodiment of the antenna of the present invention configured for operation in the 7 MHz band.

Referring now to FIG. 3, a top view of the antenna is shown with the wires 52 and 54 completely wound onto spools 44 and 46. In this configuration, wires 56 and 58 are completely extended from spools 48 and 50 to form the driven element and the antenna acts as a bent dipole. With the wire lengths extended from each of the third and fourth spools about 38.97 ft. as shown (for a total length of about 77.94 ft.), the antenna resonates at about 6.94 MHz. Wires 52 and 54 do not extend appreciably, if at all, from spools 44 and 46, and do not form part of the antenna.

Figure 4:
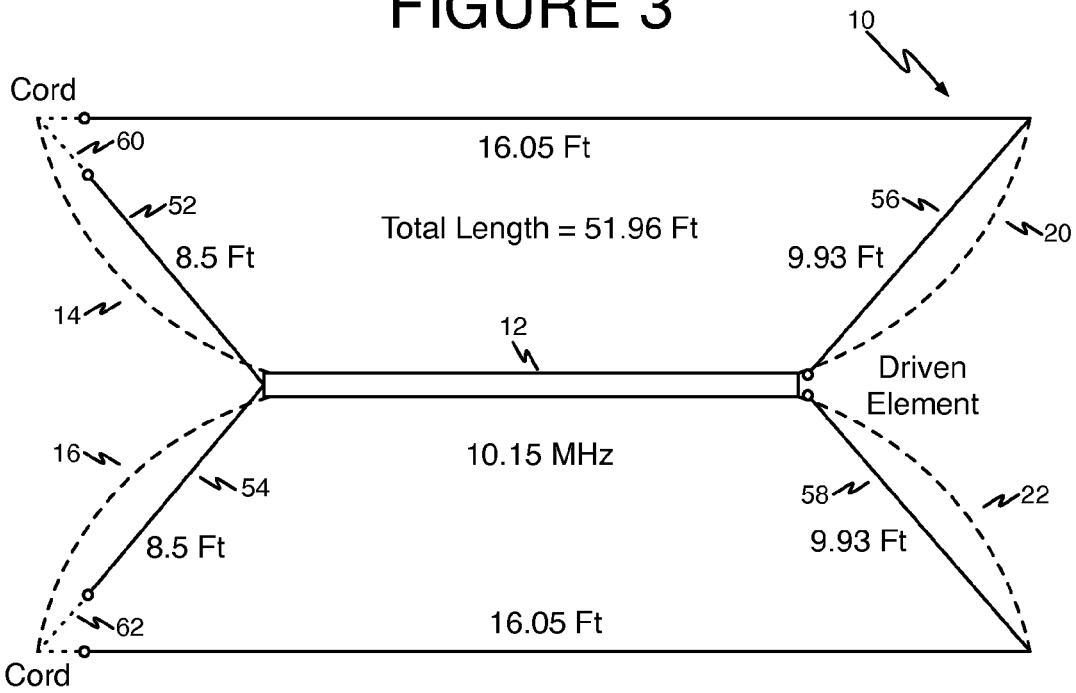
FIG. 4 is a diagram showing a top view of the illustrative embodiment of the antenna of the present invention configured for operation in the 10 MHz band.

Referring now to FIG. 4, a top view of the antenna is shown with the wires 52 and 54 partially extended from spools 44 and 46 so that the extended length of each of the wires extending from spools 48 and 50 is about 25.98 ft. (for a total length of about 51.96 ft.). The antenna is still configured as a bent dipole and resonates at about 10.15 MHz. As shown in FIG. 4, wires 52 and 54 extending from spools each have lengths of about 8.5 ft. The wires unwound from spools 44 and 46 are insulated from the wires extending from spools 48 and 50 by the non-conductive cords 60 and 62, respectively. At lengths of about 8.5 ft., the parasitic element formed by these wires is out of resonance, thus presenting a high impedance. This element does not form a part of the antenna.

Figure 5:
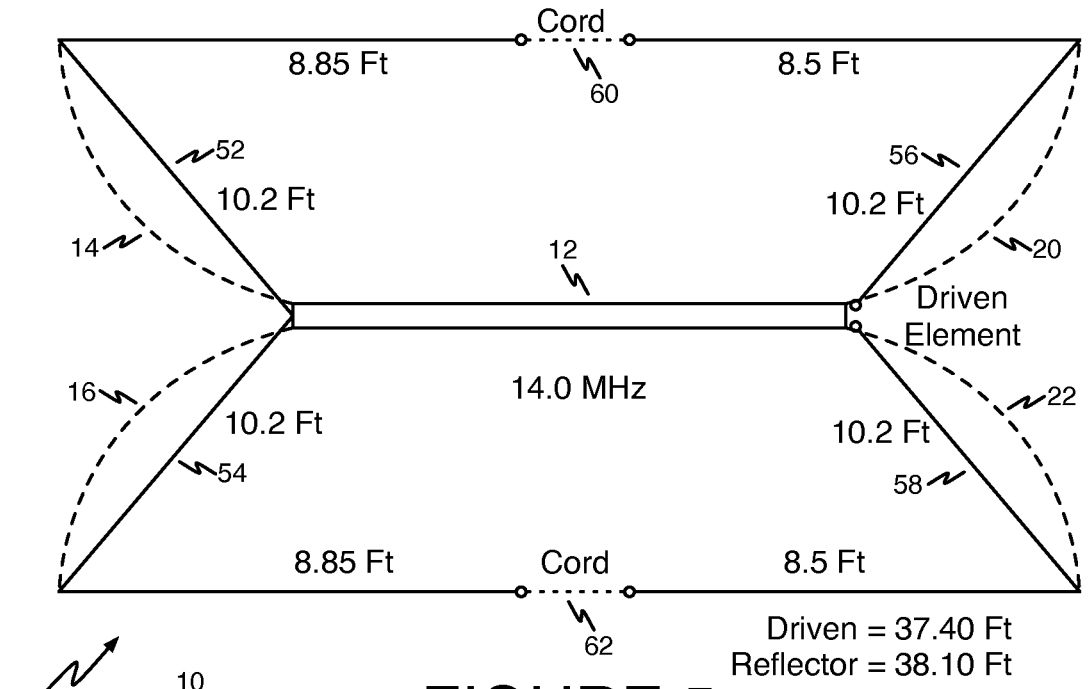
FIG. 5 is a diagram showing a top view of the illustrative embodiment of the antenna of the present invention configured for operation in the 14 MHz band.

Referring now to FIG. 5, a top view of the antenna is shown with the wires 56 and 58 further wound onto spools 48 and 50 so that the extended length of each of the wires extending from spools 48 and 50 is about 18.7 ft. (for a total length of about 37.40 ft.). The wires 52 and 54 on spools 44 and 46 are further unwound so that, in the configuration shown in FIG. 5, wires 52 and 54 extending from spools 44 and 46 each have lengths of about 19.05 ft. (for a total length of about 38.10 ft.). Wire 56 is insulated from wire 52 and wire 58 is insulated from wire 54 by cords 60 and 62, respectively. Persons of ordinary skill in the art will appreciate that the antenna is now configured as a two-element Yagi with wires 52 and 54 extending from spools 44 and 46 functioning as a reflector element. The two-element Yagi shown in FIG. 5 resonates at about 14.0 MHz.

Figure 6:
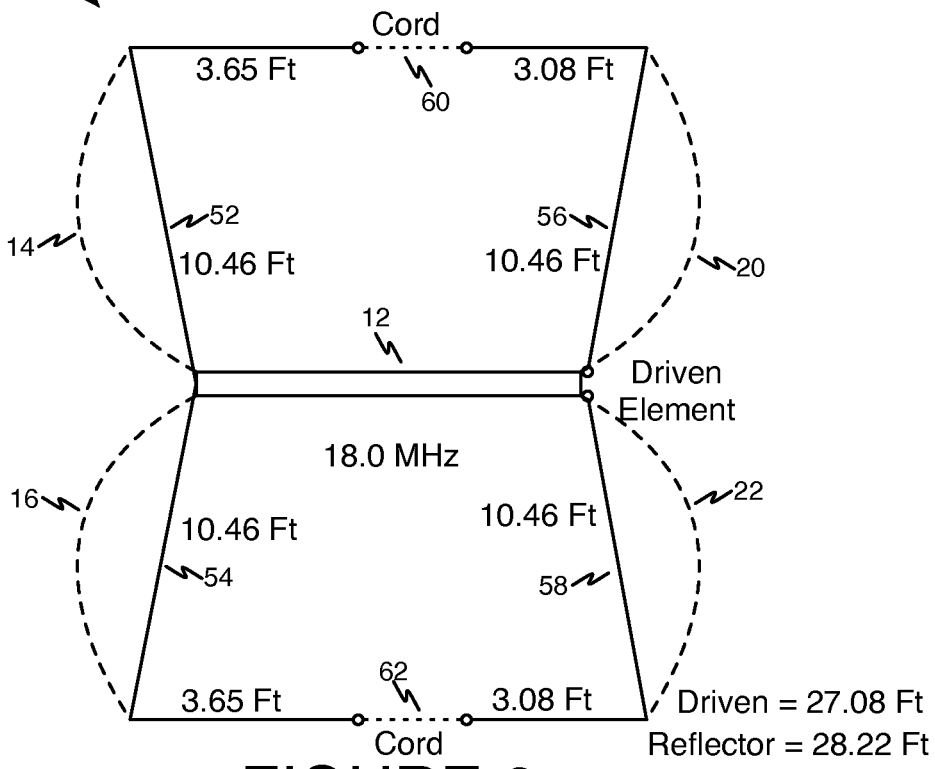
FIG. 6 is a diagram showing a top view of the illustrative embodiment of the antenna of the present invention configured for operation in the 18 MHz band.

Referring now to FIG. 6, a top view of the antenna is shown with wires 56 and 58 further wound onto spools 48 and 50 so that the extended length of each of wires 56 and 58 is about 13.54 ft. (for a total length of about 27.08 ft.). Wires 52 and 54 extending from spools 44 and 46 are further wound so that, in the configuration shown in FIG. 6, wires 52 and 54 each have lengths of about 14.1 ft. (for a total length of about 28.22 ft.). Persons of ordinary skill in the art will appreciate that the antenna of FIG. 6 is also configured as a two-element Yagi with wires 52 and 54 extending from spools 44 and 46 functioning as a reflector element. The two-element Yagi shown in FIG. 6 resonates at about 18.0 MHz.

Figure 7:
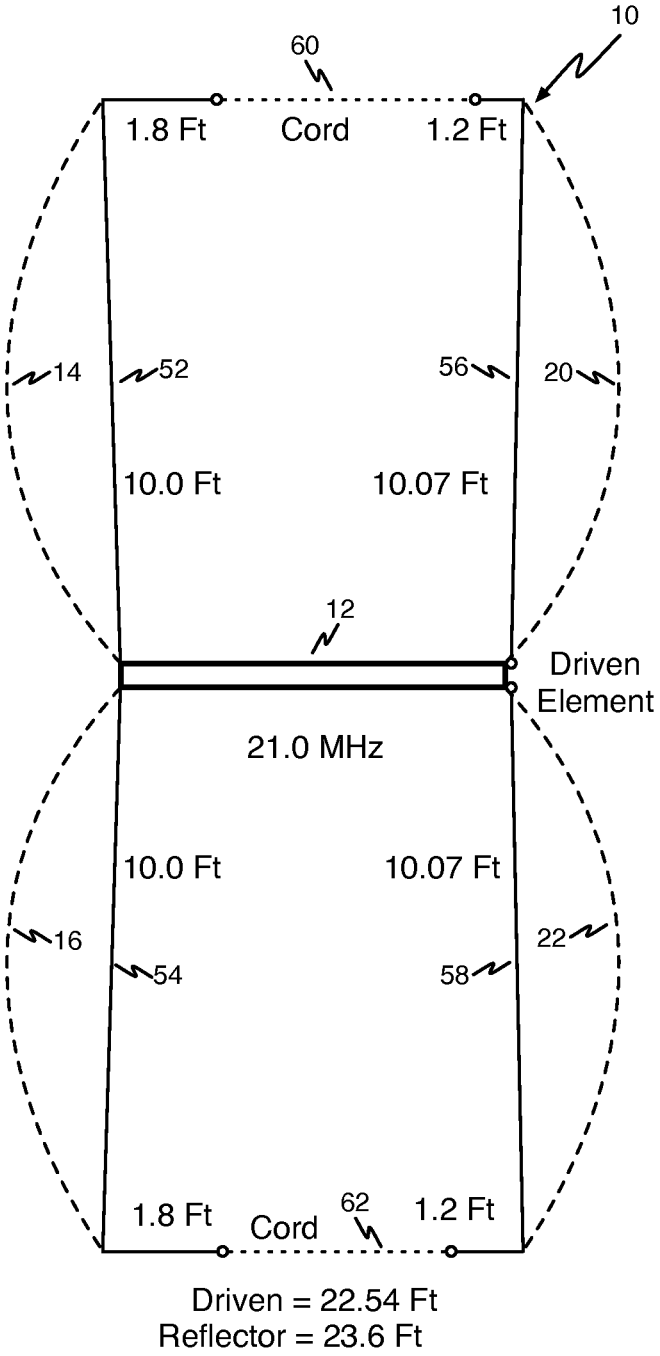
FIG. 7 is a diagram showing a top view of the illustrative embodiment of the antenna of the present invention configured for operation in the 21 MHz band.

Referring now to FIG. 7, a top view of the antenna is shown with wires 56 and 58 further wound onto spools 48 and 50 so that the extended length of each of wires 56 and 58 is about 11.27 ft. (for a total length of about 22.54 ft.). Wires 52 and 54 on spools 44 and 46 are further wound so that, in the configuration shown in FIG. 7, wires 52 and 54 each have lengths of about 11.8 ft. (for a total length of about 23.6 ft.). Persons of ordinary skill in the art will appreciate that the antenna of FIG. 7 is also configured as a two-element Yagi with wires 52 and 54 extending from spools 44 and 46 functioning as a reflector element. The two-element Yagi shown in FIG. 7 resonates at about 21.0 MHz.

Figure 8:
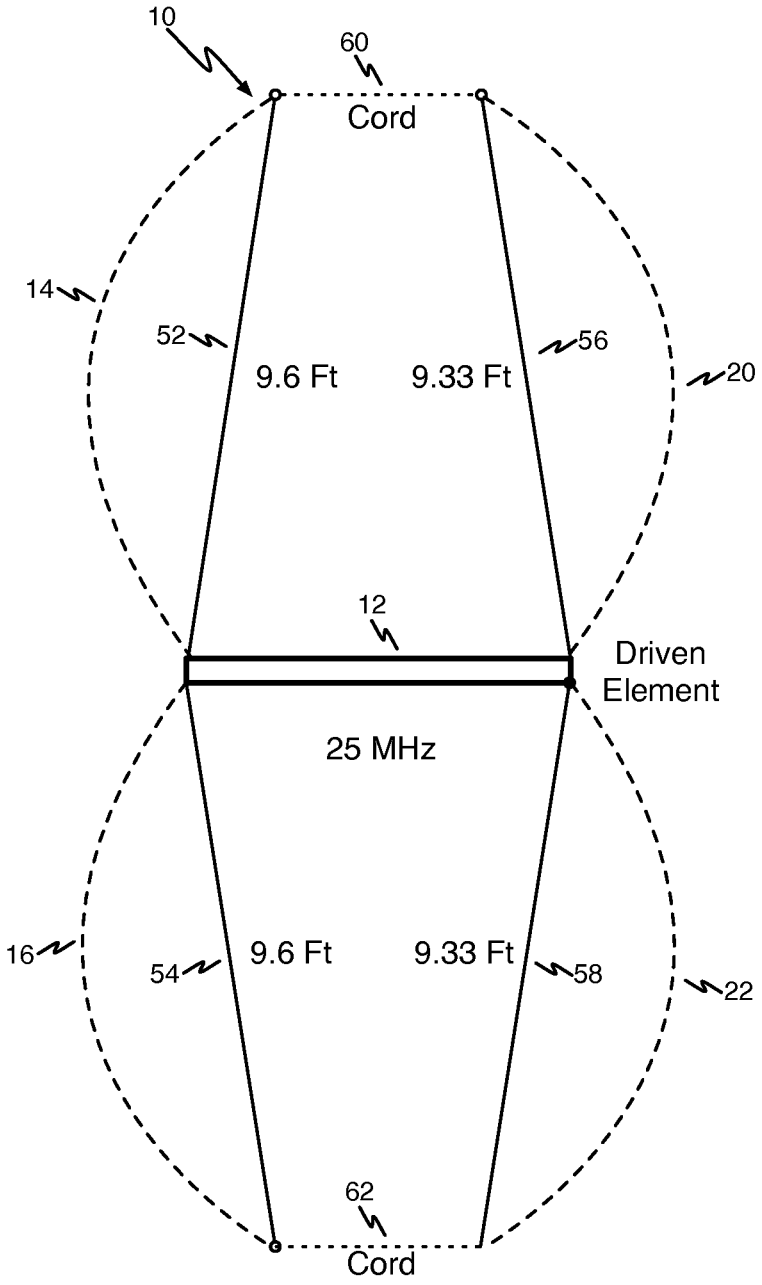
FIG. 8 is a diagram showing a top view of the illustrative embodiment of the antenna of the present invention configured for operation in the 25 MHz band.

Referring now to FIG. 8, a top view of the antenna is shown with wires 56 and 58 further wound onto spools 48 and 50 so that the extended length of each of wires 56 and 58 is about 9.33 ft. (for a total length of about 18.67 ft.). Wires 52 and 54 are further wound from spools 44 and 46 so that, in the configuration shown in FIG. 8, wires 52 and 54 each have lengths of about 9.6 ft. (for a total length of about 19.20 ft.). Persons of ordinary skill in the art will appreciate that the antenna of FIG. 8 is also configured as a two-element Yagi with the wires 52 and 54 extending from first and second spools functioning as a reflector element. The two-element Yagi shown in FIG. 8 resonates at about 25.0 MHz.

Figure 9:
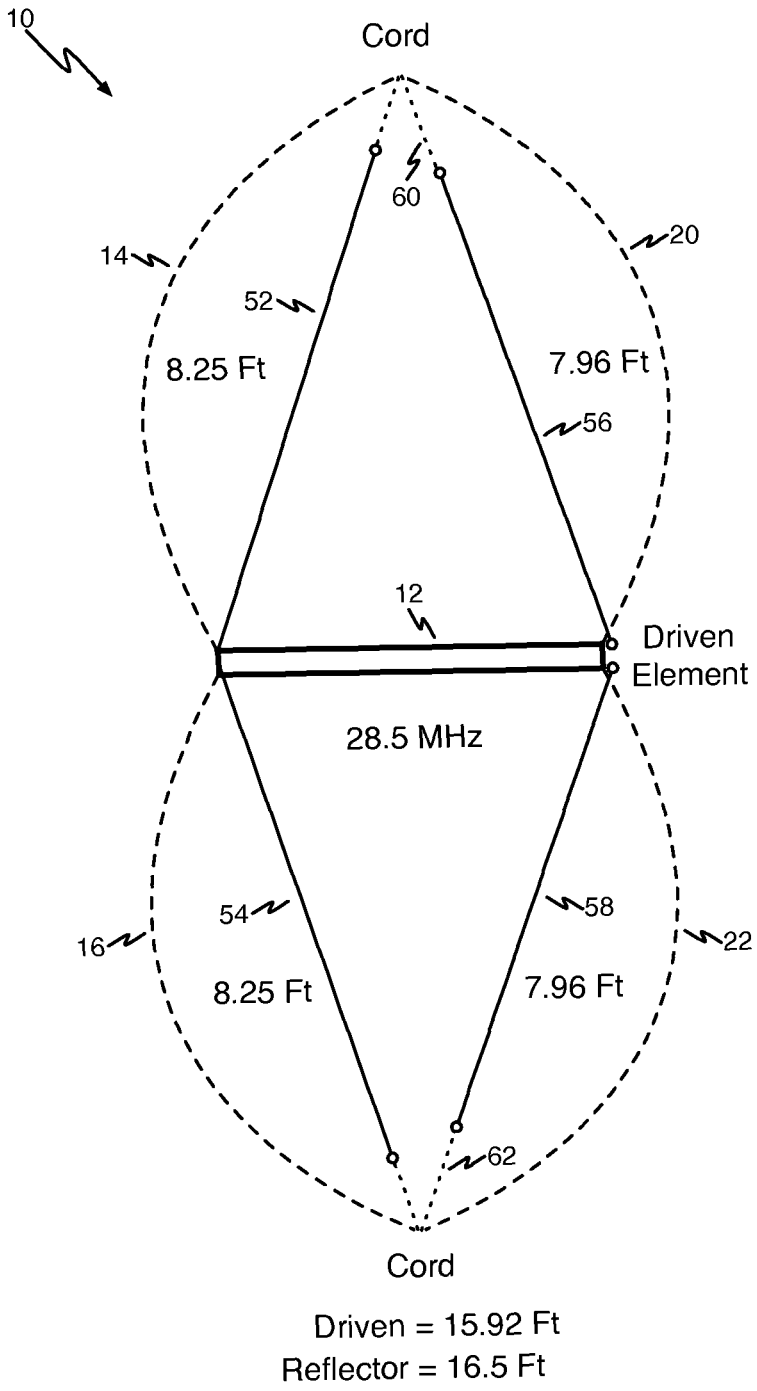
FIG. 9 is a diagram showing a top view of the illustrative embodiment of the antenna of the present invention configured for operation in the 28.5 MHz band.

Referring now to FIG. 9, a top view of the antenna is shown with wires 56 and 58 further wound onto spools 48 and 50 so that the extended length of each of wires 56 and 58 is about 7.96 ft. (for a total length of about 15.92 ft.). Wires 52 and 54 are further wound onto spools 44 and 46 so that, in the configuration shown in FIG. 9, wires 52 and 54 each have lengths of about 8.25 ft. (for a total length of about 16.5 ft.). Persons of ordinary skill in the art will appreciate that the antenna of FIG. 9 is also configured as a two-element Yagi with the wires 52 and 54 extending from spools 44 and 46 functioning as a reflector element. The two-element Yagi shown in FIG. 9 resonates at about 28.5 MHz.

From an examination of FIGS. 3 through 9, persons of ordinary skill in the art will realize that, as the resonant frequency increases and the total length of each wire becomes shorter, the poles 14, 16, 20, and 22 increasingly flex away from the boom 12 and towards each other past the ends of the boom 12.

From the above examples, persons of ordinary skill in the art will realize that the construction of the antenna of the present invention facilitates spooling and unspooling the wire to specific lengths required to provide a high performance antenna that covers a continuous frequency change of four to one or greater. On the driven element end of the boom the spools are electrically isolated to allow feeding and receiving radio frequency to and from the antenna. The power can be transferred in several ways, such as, but not limited to employing brushes to contact the metal driven element spools to accomplish power transfer. On the passive element end the wires on the spools are electrically connected so as to form a passive element. When operating as a dipole, in the embodiments shown in FIGS. 3 and 4, the passive element is out of resonance and exhibits a high impedance, thus having no effect on the operation of the dipole. The passive element is simply retracted the appropriate amount onto its reels as the driven element is further extended to resonate at the low frequency range of the antenna, leaving the passive element extended to lengths that have little or no effect on the dipole function.

To change the length of either element the spool shaft is simply turned in one direction or the other on the element to be changed and the wire will either be played out or reeled in, thus shortening or lengthening the element. Since the elements are tied together the poles bend and pivot in response the change in the element length, thus changing the shape of the antenna. More specifically, as the element lengths are both shortened, as can be seen from an examination of FIGS. 3 through 9, the elements move closer together which optimizes the spacing on the Yagi antenna as the frequency is changed. Additionally the design of the present invention produces a Moxon shape from about 14 MHz to about 21 MHz, thus greatly improving performance on these frequencies. To create a Yagi the two elements are relatively close in length, the length differences ranging from about 6 inches to about 18 inches over the 14 MHz to 30 MHz range, thus causing the antenna to take on a relatively symmetrical shape. The poles are spring loaded using for example, bungee cords. This loading, plus the flex of the poles keeps the wires taut even in windy conditions. The guides at the ends of the poles may be provided with pulleys to allow the wire move through the guides with little friction.

Figure 10:
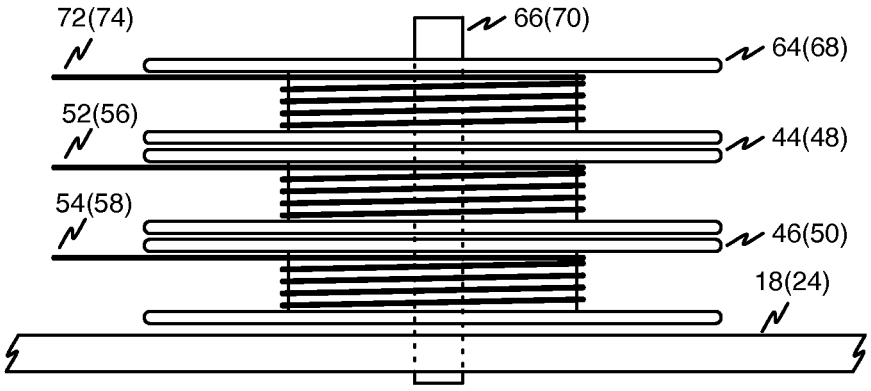
FIG. 10 is a diagram showing a manually driven embodiment for adjusting the wire element lengths of an antenna in accordance with the present invention.

According to one aspect of the present invention shown with reference to FIG. 10, a third spool may be provided on each element spool shaft and locked to the shaft so that all three spools will turn together. Third spool 64 is shown mounted on spool shaft 66 on mounting plate 18 along with spools 44 and 46 and third spool 68 is shown mounted on shaft 70 on mounting plate 24 along with spools 48 and 50. A non-conductive pull cord 72 is wound around the third spool 64 and a non-conductive pull cord 74 is wound around the third spool 68. When pulled from the ground, pull cords 72 and 74 will rotate the other two spools with which they are ganged on the shaft, enabling simultaneous winding and unwinding of the other two spools to increase and decrease the lengths of the wire elements wound on the other two spools.

The pull cords are configured such that when pull cord 72 is fully unwound from its spool, the wires 52 and 54 associated with the ganged spools 44 and 46 will be fully wound on their spools. The wires 56 and 58 will be fully played out from ganged spools 48 and 50 and the other pull cord 74 will be fully wound on spool 68 as shown in the dipole antenna configuration depicted in FIG. 3. As pull cord 74 is pulled to unwind it from its spool 68, wires 56 and 58 will be wound on to ganged spools 48 and 50. By separately controlling pull cords 72 and 74, all of the antennas depicted in FIGS. 3-9 can be configured. Indicator marks can be provided on the pull cords to indicate proper wire lengths for selected frequencies or frequency bands. In such an embodiment, persons of ordinary skill in the art will appreciate that both pull cords 72 and 74 are required as the length of each element must be separately adjusted for proper performance. Guide rings or pulleys (shown with reference to FIG. 12) can be provided at the top of the mast or support pole to which the boom will be mounted during operation of the antenna to change the direction of the pull cords from vertical to horizontal at the top of the mast.

The antenna is adjusted by winding up or feeding out the wire elements, both the driven element and the passive element. In one embodiment, an adjustment spool that allows only a single layer of wire is used so that turning the adjustment spool a given amount always feeds out the same length of wire to maintain length calibration. This can be done either manually or electrically by having a motor turn the spools remotely.

In a simple embodiment, a cord provided for each element with hook rings or marks for each desired frequency range could be simply hand pulled down to a hook mounted on the mast. To change frequency, each cord is moved to the desired mark and reattached to the hook attached to the mast.

Figure 11:
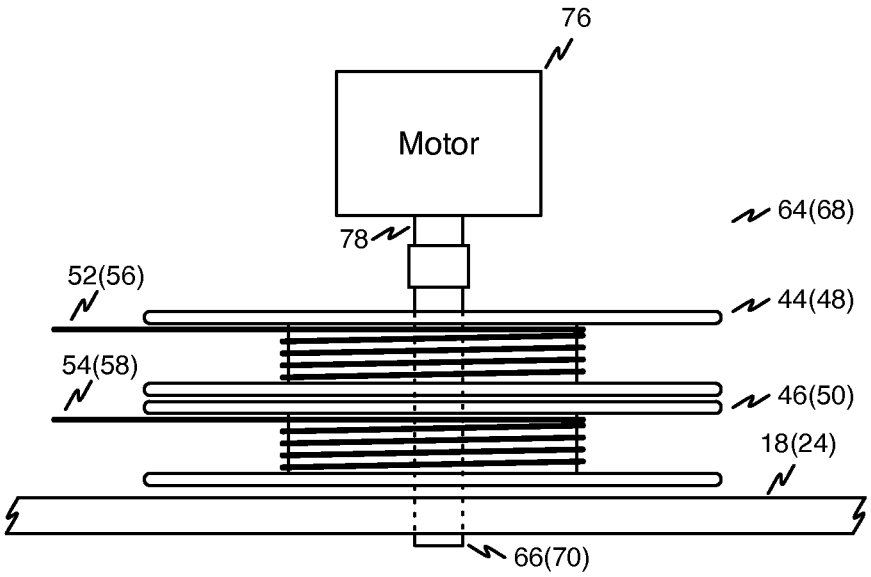
FIG. 11 is a diagram showing a motor driven embodiment for adjusting the wire element lengths of an antenna in accordance with the present invention.

In a motor driven embodiment such as the one depicted in FIG. 11, a motor 76, such as a stepper motor is employed. the motor shaft 78 is mechanically coupled coupled, either directly or indirectly, to the shaft 66 or 70 holding the spools on which the antenna wires are wound. As will be appreciated by persons of ordinary skill in the art, the shaft 66 or 70 could be fixedly mounted on mounting plates 18 and 24 and the motor shaft 78 could be coupled to the ganged spools. The DC power and control signals can all be multiplexed over the coaxial feedline to the antenna or can be supplied by a discrete control/power cable as is known in the art. This allows remote automatic or manual operation from the radio location. The control unit for the motors can either read the frequency of the transmitter using a frequency counter circuit, read the frequency of the transmitter digitally, or respond to manual inputs from the operator. The antenna of the present invention has a very high Q so the lowest SWR and the best performance point at a given frequency coincides, thus allowing the antenna to be adjusted using lowest SWR as the indicator.

Figure 12:
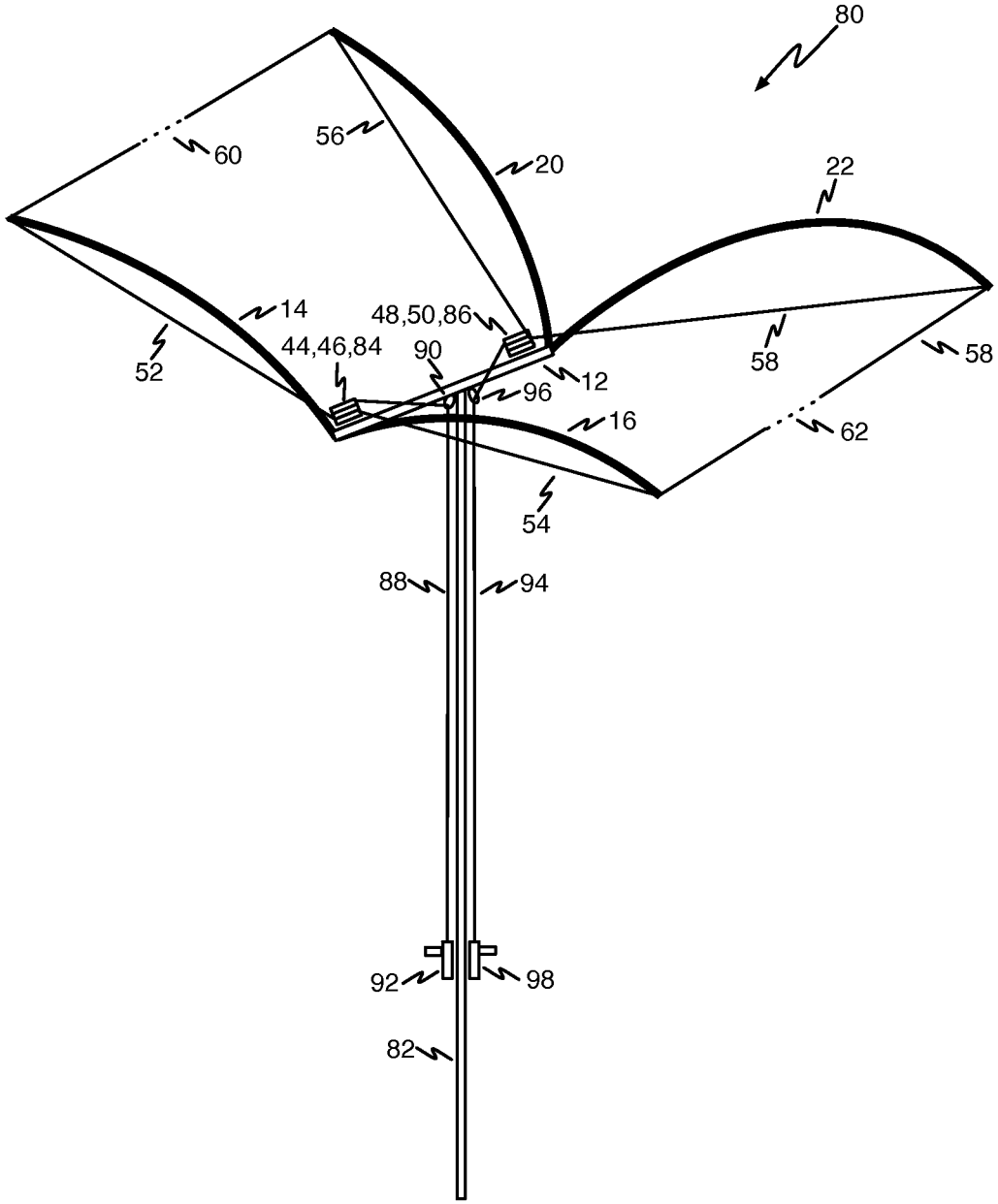
FIG. 12 is an isometric view of an antenna such as the ones shown in FIGS. 1 through 9, showing an illustrative way of adjusting the lengths of the wires forming the antenna.

One non-limiting illustrative embodiment is shown in FIG. 12, an isometric view of an antenna 80 such as the ones shown in FIGS. 1 through 9. Numerous ones of the elements depicted in FIGS. 1 through 9 are present in FIG. 12. Accordingly, the same reference numerals used to depict these elements in FIGS. 1 through 9 are used to identify corresponding elements in FIG. 12.

Thus, antenna 80 in FIG. 12 is formed on boom 12 and includes two pairs of opposed element support poles 14 and 16 and 20 and 22. Wire 52 is deployed from spool 44 and passes through a guide at the end of pole 14 and wire 56 is deployed from spool 48 and passes through a guide at the end of pole 20. The ends of wires 52 and 56 are joined by a length of non-conductive cord 60. Similarly, wire 54 is deployed from spool 46 and passes through a guide at the end of pole 16 and wire 58 is deployed from spool 50 and passes through a guide at the end of pole 22. The ends of wires 54 and 58 are joined by a length of non-conductive cord 62. The antenna 80 is mounted on mast 82.

A third spool 84 is ganged with spools 44 and 46 and another third spool 86 is ganged with spools 48 and 50. A first non-conductive adjustment cord 88 for adjusting the lengths of wires 52 and 54 is wound around spool 84, passes through guide ring 90 and is wound on adjustment spool 92. A second non-conductive adjustment cord 94 for adjusting the lengths of wires 56 and 58 is wound around spool 86, passes through guide ring 96 and is wound on adjustment spool 98.

The adjustment cords 88 and 94 are shown as being adjusted with hand cranked spools 92 and 98 mounted on the support mast 82 at a vertical location within reach of an operator. Adjustment spools 92 and 98 may have an attached turns counter that can be marked or calibrated for each frequency range. The adjustment cords 88 and 94 could also be marked with a calibration scale so that the crank can simply be turned to the desired position as observed by the operator, thus eliminating the turns counter. Using the control lines 88 and 94 it is possible to change the antenna 80 to a bi-directional beam or a beam pointing in the opposite direction as is known in the antenna art, thus saving time by eliminating the need to rotate the antenna.

The resonant frequency of the antenna of the present invention can also be adjusted using motors with a control unit at the operating position. The DC power and control signals can all be multiplexed over the coaxial feedline to the antenna or can be supplied by a discrete control/power cable as is known in the art. The hand cranked adjustment spools 92 and 98 can also be turned with a motor that has the ability to accurately position the spool. This allows remote automatic or manual operation from the radio location. The motors can also be mounted up on the antenna boom or mounting plates on the boom and be provided on a common shaft with or mechanically linked to the ganged spool assemblies, thus eliminating the cord altogether. The control unit for the motors can either read the frequency of the transmitter using a frequency counter circuit, read the frequency of the transmitter digitally, or respond to manual inputs from the operator. The antenna of the present invention has a very high Q so the lowest SWR and the best performance point at a given frequency coincides, thus allowing the antenna (the Yagi type as well) to be adjusted using lowest SWR as the indicator.

The poles can be made from many materials as long as they are RF transparent at frequencies at which the antenna is to operate and have suitable strength and weight. The poles can be made from either telescoping or sectional poles to allow for the smallest possible shipping package prior to assembly by a user. The base of each pole is mounted on a pivot assembly, thus allowing the poles to swing inward towards each other as the antenna is made shorter. This requires much less bending of the poles and results in easier adjustment because there is less tension on the lines. The pivot point can also be changed and have the pole pivot somewhere along it's length to allow other antenna shapes and profiles and greater frequency coverage. The poles can be mounted rigidly if a suitably flexible pole is used. The pivoting poles can use springs, torsion bars, or elastic cord to allow them to move and keep the proper tension on the element wires. In both directions, a mechanical stop limits the movement of each of the poles. The poles are biased against the stops using, for example, an elastomeric member such as a bungee cord.

The wire size used in the antenna of the present invention can be various different gauges depending on the desired power handling requirement. Persons of ordinary skill in the art will appreciate that the wire gauge also affects the usable bandwidth of the antenna before retuning is necessary, larger wire sizes providing a wider bandwidth. Such skilled persons will also appreciate that insulated wire can also be used to increase wear resistance as well as to reduce the physical size of the antenna (about 3 percent) due to the dielectric loading provided by the insulation. The elements can also be made from conductive tape to provide even greater bandwidth, which will require less frequent adjustment of the antenna.

RF power can be supplied to the driven element of an antenna according to the present invention in several ways. In one embodiment, brushes are employed that contact the metallic reels that hold the wire. In another embodiment, conductive pulley wheels can be employed to guide and provide contact to the antenna wire elements. In yet another embodiment, the wires can be run through a conductive tube of the appropriate length resulting in a non-contact capacitive coupling.

The antenna of the present invention may be designed to present a 50 ohm impedance with a direct feed to the transmitter/receiver. Persons of ordinary skill in the art will appreciate that it can easily be adjusted to present an impedance of 25 ohms with slightly better performance by simply adjusting the element lengths and adding a matching circuit to convert the 25 ohm antenna impedance to the desired standard 50 ohm load.

Figure 13:
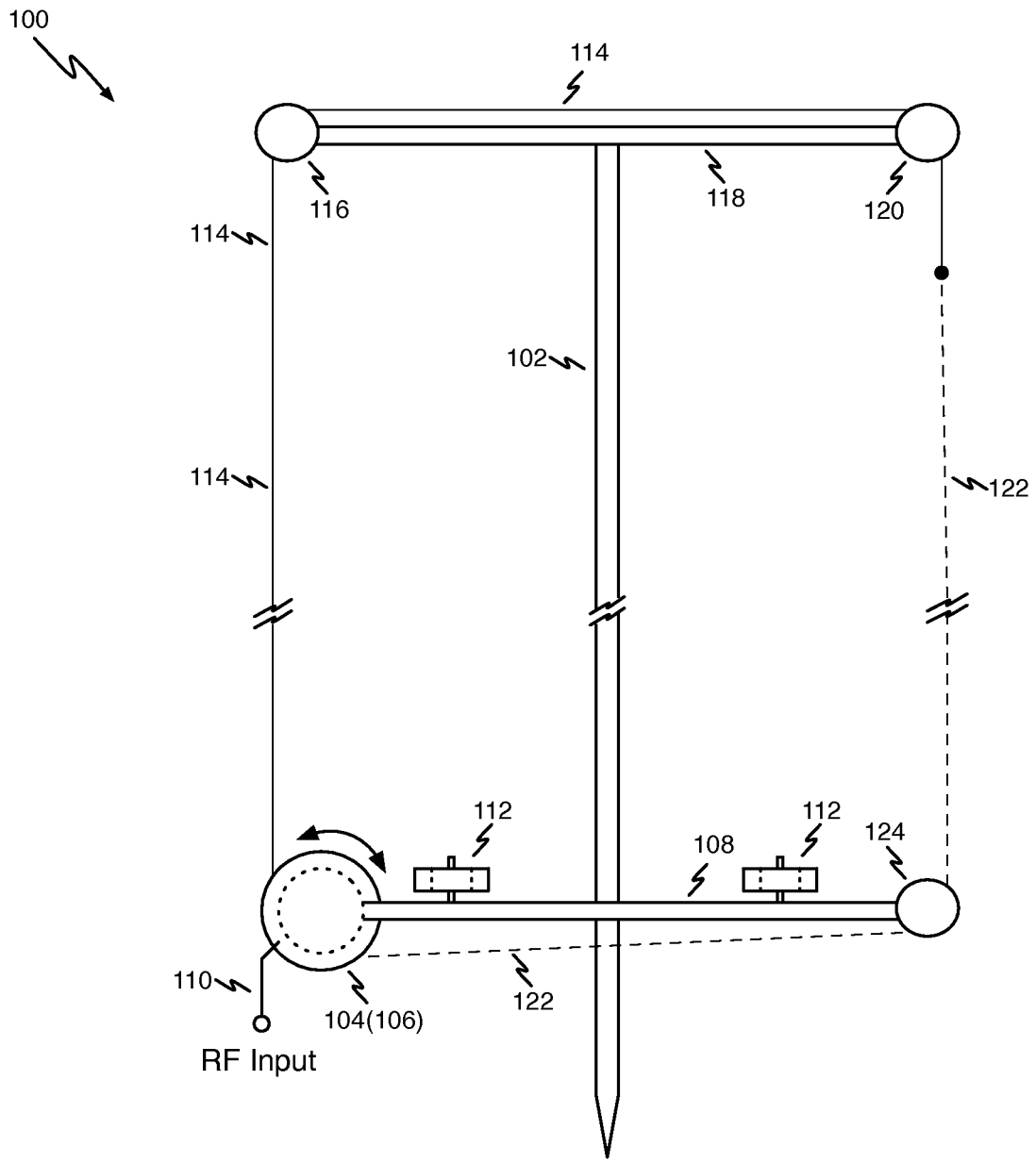
FIG. 13 is a diagram showing an illustrative embodiment of the present invention in the form of a vertical antenna or one side of a dipole antenna.

Referring now to FIG. 13, an illustrative embodiment of an antenna 100 in accordance with the present invention in the form of a vertical antenna or one side of a dipole antenna is shown. The antenna 100 is supported by a pole 102 that is non-conductive at the frequencies of interest of the antenna. In an embodiment forming a vertical antenna, the pole 102 may have a pointed tip or be insertable into a pointed tip that can be driven into the ground. A tree or other existing non-conductive support can be used in place of a pole.

A pair of ganged spools 104 and 106 are disposed near the bottom of the pole and may be mounted on a lower cross-member 108 or other support as shown in FIG. 13. The spools may be driven manually or using motors as disclosed with reference to the other embodiments of the invention herein. The spool containing the wire is electrically coupled to a connector 110 for supplying RF energy to the antenna. When the antenna element is used as a vertical antenna, the ground side of the RF energy source is coupled to one or more radials connected to the ground side of the antenna and deployed from the support member 108. When the antenna element is used as a dipole antenna, the ground side of the RF energy source is coupled to a connector like connector 110 on the other half of the dipole.

When the antenna element is mounted vertically to serve as a vertical antenna, the lower crossmember 108 or other support may also have one or more spools 112 attached thereto for deploying ground or elevated radials from the ground side of the antenna. Alternately, the lower crossmember 108 or other support may be fitted with attachment points for the ends of one or more ground radials to extend therefrom.

A first one of the spools 104 is wound with wire 114 that will form the vertical antenna. The wire is directed upwards from the spool 104 and through a first pulley 116 mounted on an upper crossmember or other support structure 118 at the top of the pole 102, directed through a second pulley 120 mounted on the upper crossmember 118 in a downward direction. A non-conductive cord 122 is attached to the end of the wire. The non-conductive cord 122 is wound on the second spool 106 in a direction opposite to the direction that the wire 114 is wound on the first spool 104. The upper crossmember 118 may be flexible, in the form of, for example, a flexible fiberglass pole, in order to apply tension to the wire 114 and non-conductive cord 122 in order to compensate for any slack caused by the simultaneous winding and unwinding of the wire 114 and the non-conductive cord 122 from spools 104 and 106. Persons of ordinary skill in the art will readily appreciate that there are other known ways to take up the slack, such as spring mounting one or more of the pulleys.

Non-conductive cord 122 is shown directed through a third pulley 124, directing it back towards second spool 106 through spools 120 and 116. As the ganged spools 104 and 106 are rotated, either the wire 114 is played out and the non-conductive cord 122 taken up, or the wire 114 is taken up and the non-conductive cord 122 played out to vary the length of the wire 114 forming the antenna element. Persons of ordinary skill in the art will appreciate that a single pulley can be used on the end of pole 102 in place of pulleys 116 and 120, so long as it has a diameter sufficiently large to provide the amount of capacitive loading needed to provide a shortened element in accordance with the present invention. For example, at 14 MHz, a diameter of about 9 inches is sufficient. Such a pulley could be provided with a spring mounted shaft to accommodate the aforementioned slack.

As with the first embodiment of the present invention, RF power can be supplied to the antenna according to the present invention in several ways. In one embodiment, the ganged spools 104 and 106 are formed from a metal or other conductive material and brushes are employed that contact one or both of the side faces of the metallic ganged spools that hold the wire 114. In another embodiment, conductive pulley wheels or sleeves can be employed to guide and provide contact to the wire 114. In yet another embodiment, the wire 114 can be run through a dielectric lined conductive tube of the appropriate length resulting in a non-contact capacitive coupling.

A pair of antenna elements such as the ones shown in FIG. 13 can be mounted in opposing configuration and used as a dipole antenna. As the wire 114 from each arm of the dipole becomes longer, the frequency of operation decreases. At the point where the wire is turned around the pulleys 116 and 120, the element becomes a folded element as will be appreciated by persons of ordinary skill in the art.

One advantage of the antenna of the present invention is that it uses wire, or conductive tape that is accurately spooled out using physical control lines manually from the ground or automatically by a motor, so the antenna doesn't need to be brought down to adjust or change it. This is an important feature because otherwise to adjust the antenna impedance would require using the cut-and-try method, raising and lowering the antenna potentially many times. The antenna elements are made physically shorter (i.e., the elements are "electrically shortened") by folding it back on itself, as described in application Ser. No. 11/684,323 filed on Mar. 9, 2007 to allow them to be physically 40% to 50% smaller than a full-sized elements at the same frequency.

Making the elements physically shorter in this manner is very efficient and results in much lower losses than inductive loading. A 40% reduction in length with a simple looped end fold-back results in only a 0.30 dB loss. This folding can take many different shapes and can reduce the physical size of an element even more than 40%, however, the loss will be slightly higher as the size decreases. Because the element physically changes size and is made shorter by capacitive loading it is capable of handling power levels of 3 kW or more.

Another advantage of the antenna of the present invention is the ability of the support member(s) that holds the wire element to change shape by changing the amount of flex as it is adjusted. Yet another advantage of the antenna of the present invention is the ability to change the position of the support pole via a pivot (or hinge) mechanism.

The antenna of the present invention provides a vertical or dipole radiator that is very efficient, covers the frequency range continuously, is adjustable from the ground, and is 40% smaller than a full-sized physical element. In the case of a Yagi configuration the antenna of the present invention allows a two to one frequency change, while maintaining nearly optimal performance over the entire range. The performance is equal to or better than a full-sized two element Yagi.

The antenna of the present invention provides numerous other advantages over prior-art antennas. In the disclosed embodiment it employs an element design that is suitable for use in a small, lightweight, high performance, high power, vertical, dipole, or Yagi antenna. It provides a two element portable Yagi covering 20 m to 6 m with dipole coverage on 40 m and 30 m, comparable in performance to a full size Yagi of the same number of elements. Yagi performance from 14 MHz to 21 MHz is equal to full-sized performance because the antenna assumes a Moxon configuration on these frequencies. (Moxon antennas are Yagi antennas with the tips of the element bent in at 90 degrees towards each other, resulting in small size with high performance). The antenna is lightweight, weighing only about 12 lb. It can be manufactured to be extremely portable, and in one presently contemplated embodiment, breaks down to a package having a maximum length of 26 inches. It is quick and easy to assemble, taking only 5 to 10 minutes. It has a very low visual profile and a very low windload, about 2 square feet. It has a small size when assembled; at 40 m-20 m; it is 20' long by 13.2' wide; at 17 m through 10 m it has a size that varies from 18' long by 14' wide (17 m) to 20' wide by 6' long (10 m).

The antenna of the present invention in the above-described illustrative embodiment is only one of many form factors possible. If a larger physical footprint is acceptable the antenna can be made larger by simply increasing the length of the boom, and/or poles, resulting in increased performance on the lower frequency ranges of the antenna. The dimensions used on the antenna described in the disclosed embodiment were chosen as a reasonable compromise between size and performance. Shown below are performance figures for the antenna at 25 ohm impedance. Various other impedances can be chosen but it is believed that 25 ohms gives the best overall performance.

| FREQUENCY | GAIN | FRONT/BACK RATIO | 2:1 SWR BANDWIDTH (without adjusting antenna) |
|---|---|---|---|
| 7.0 MHz | 0.44 dBi | 6.2 dB (front to side) | 50 kHz |
| 10.1 MHz | 1.19 dBi | 10.7 dB (front to side) | 220 kHz |
| 14.0 MHz | 6.0 dBi | 13.0 dB | 330 kHz |
| 18.0 MHz | 6.4 dBi | 11.0 dB | 300 kHz |
| 21.0 MHz | 6.3 dBi | 12.0 dB | 360 kHz |
| 25 MHz | 6.6 dBi | 10.0 dB | 350 kHz |
| 28.5 MHz | 6.1 dBi | 13.0 dB | 400 kHz |

The antenna of the present invention covers the above frequency spectrum continuously with a typical SWR of 1.3:1. The, performance between the data points in the table above can be simply extrapolated to determine the performance at other frequencies.

When the antenna of the present invention is configured as a dipole, additional advantage can be obtained by separately controlling the length of each side of the dipole element. When the antenna of the present invention is configured as a vertical antenna, the radials are tunable, as well as the vertical portion of the antenna. Persons of ordinary skill in the art will recognize this as a form of off-center feeding that allows the antenna to be matched in a variety of different impedances by changing the lengths of each portion of the antenna as needed, without using a matching system such as an unun.

The ability to automatically tune the length of the elements and the radials can be built into the antenna through use of an electronic controller such as the controller available from Steppir Antennas of Bellevue, Wash.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A tunable antenna, comprising:

a boom;

a first and a second opposed non-conductive support pole extending from a first end of the boom each having a wire guide at a distal end thereof;

a third and a fourth opposed non-conductive support pole extending from a second end of the boom each having a wire guide at a distal end thereof;

first and second spools rotatably mounted proximate to the first end of the boom;

third and fourth spools rotatably mounted proximate to the second end of the boom;

a first wire spooled on the first spool in a first direction;

a second wire spooled on the second spool in a first direction;

a third wire spooled on the third spool in a direction opposite the first direction and mechanically coupled to the first wire by a length of non-conductive cord, the first and third wires running through the guides on the first and third poles; and a fourth wire spooled on the fourth spool in a direction opposite the first direction and mechanically coupled to the second wire by a length of non-conductive cord, the second and fourth wires running through the guides on the second and fourth poles.

2. The tunable antenna of claim 1 wherein;

the first and second support poles are spring biased against stops limiting a maximum angle that the first and second support poles can extend from the boom; and the third and fourth support poles are spring biased against stops limiting a maximum angle that the third and fourth support poles can extend from the boom.

3. The tunable antenna of claim 1 wherein;

the first and second spools are ganged; and the third and fourth spools are ganged.

4. The tunable antenna of claim 1 wherein;

the first and second spools are releaseably ganged; and the third and fourth spools are releaseably ganged.

5. The tunable antenna of claim 1 wherein the guides comprise pulleys.

6. The tunable antenna of claim 1 further comprising:

a first rotating mechanism remote from the first and second spools and coupled to the first and second spools;

a second rotating mechanism remote from the third and fourth spools and coupled to the third and fourth spools.

7. The tunable antenna of claim 6 wherein the first and second rotating mechanisms are hand actuated.

8. The tunable antenna of claim 6 wherein the first and second rotating mechanisms are motor actuated.

9. The tunable antenna of claim 1 wherein the first and second spools are releaseably ganged.

10. A tunable antenna element comprising:

a support pole;

first and second spools rotatably mounted proximate to a first end of the support pole;

an upper cross member formed from a flexible material and mounted at a second end of the support pole;

spaced apart first and second guides mounted on the cross member, at least one of the first and second guides mounted at a position away from the support pole to form a tension member;

a wire wound on the first spool in a first direction; and a non-conductive cord wound on the second spool in a second direction opposite the first direction and attached to an end of the wire, the attached wire and non-conductive cord passing through the first and second guides.

11. The tunable antenna of claim 10 wherein the first and second spools are ganged.

12. The tunable antenna of claim 10 wherein the first and second guides comprise pulleys.

13. The tunable antenna of claim 10 further comprising a rotating mechanism remote from the first and second spools and coupled to the first and second spools.

14. The tunable antenna of claim 13 wherein the rotating mechanism is hand actuated.

15. The tunable antenna of claim 13 wherein the rotating mechanism is motor actuated.

16. The tunable antenna of claim 10 wherein both of the first and second guides are mounted on opposite sides of the support pole at positions away from the support pole to form tension members.

17. The tunable antenna of claim 10, further comprising:

a lower cross member mounted proximate to a first end of the support pole, the first and second spools rotatably mounted on the lower cross member; and a guide pulley mounted on the lower cross member through which the non-conductive cord from the second spool passes.

* * * * *